US005417601A

United States Patent [19]

Steiger

[11] Patent Number: 5,417,601

[45] Date of Patent: May 23, 1995

[54] TAIL TOY

[76] Inventor: Vivian E. Y. Steiger, 2801 Pine Ave., Manhattan Beach, Calif. 90266

[21] Appl. No.: 262,762

[22] Filed: Jun. 20, 1994

[51] Int. Cl.[6] ..... A63H 33/00

[52] U.S. Cl. ..... 446/28; 446/390; 273/DIG. 19

[58] Field of Search ..... 446/26–28, 446/390, 100, 97, 99, 268, 369, DIG. 901; 472/57, 51, 133, 70; 2/209.13; 112/440; 273/DIG. 17, DIG. 19, 440, 55 C

[56] References Cited

U.S. PATENT DOCUMENTS

| | | | |
|---|---|---|---|
| 2,810,576 | 10/1957 | Massey | 472/70 |
| 3,018,100 | 1/1962 | Joseph | 472/133 |
| 3,063,718 | 11/1962 | Steinkamp | 446/901 X |
| 3,343,835 | 9/1967 | Kaplan | 472/70 |
| 5,228,690 | 7/1993 | Rudell et al. | 273/DIG. 30 |

FOREIGN PATENT DOCUMENTS

| | | | |
|---|---|---|---|
| 566160 | 11/1973 | Switzerland | 446/100 |

*Primary Examiner*—Mickey Yu
*Attorney, Agent, or Firm*—Mark Lauer

[57] ABSTRACT

A toy having a tail attached to a flap which is tucked into clothing worn by a child at the rear so the tail appears to be part of the child. The flap is thin and has a large surface area for frictional engagement with the clothing. Both the flap and tail are soft and flexible, and the flap can detach from the clothing when the tail is pulled. In one embodiment, the flap can detach from the tail when pulled with a predetermined amount of force. Self expression, independence, knowledge and empathy for wildlife are promoted in the child by the toy. The flap can also house a story or picture relating to the animal represented by the tail, further interesting and enlightening the child.

18 Claims, 3 Drawing Sheets

TAIL TOY

TECHNICAL FIELD

The present invention relates to costume or ornament toys with a tail that can be attached to a child's clothing.

BACKGROUND ART

People have worn costumes and ornaments since ancient times. Also known are certain games, such as "Pin the Tail on the Donkey", which involve attachment of tails to representations of donkeys.

More recent devices for attaching ornamentation are taught, for example, in U.S. Pat. No. 4,975,987 to Teachout et al., which discloses separate and interlocking units of cloth or other flexible material, one of the units being sewn onto an article of clothing and forming a receiving unit for the other unit. In U.S. Pat. No. 5,125,864, Roberson et al. teach of a doll with a tether belt that can be tied to a child's wrist, the doll including a code for identification of the child.

It is an object of the present invention to provide toys that can be safely and easily worn by children to enhance their imaginative play and to instill in children empathy with the animals that the tails signify.

SUMMARY OF THE INVENTION

The above object has been met with a toy comprised of a tail made with soft, flexible material that is attached to a soft, flexible flap that can be tucked into a child's pants or skirt so that the tail appears attached to the child. While attached, the flap is frictionally engaged between the child's outerwear and underwear or backside. The toy is marked by an absence of sharp edges or hard objects that could injure small children, and the tail may be pulled from the clothing in response to sufficient force, so as to mitigate harm to children from pulling on the tail. To further promote safety, the tail be attached to the flap with a mechanism that releases in response to a predetermined force. The tail may have shapes and textures representative of various real or imaginary creatures, including common, endangered or extinct animals.

The toy can be attached or detached by even young children and so encourages their independent and imaginative play. The toy can also have a therapeutic value, as it encourages children to pretend that they are the animal that the tail is associated with, promoting empathy and emotional ties of the children with that animal. This encourages in children respect for nature and wildlife, especially for the tails that relate to endangered or extinct species. Having a tail also encourages children to move and dance, promoting motor skills development.

The tail has a soft coating that may be characteristic of the animal being simulated, such as a fur coating for mammals or soft plastic for reptiles or fish, or may be made of soft cloth. The flap may have a similar coating as the tail, and is thin but large in area so as to be worn comfortably but offer large surfaces for frictional attachment to a child's clothing. The flap may also be folded when worn, otherwise unfolding to reveal a picture or description of the animal represented by the tail, enhancing affiliation between the child and animal as well as offering knowledge in a format likely to interesting the child.

DESCRIPTION OF THE PREFERRED EMBODIMENT

Figure 1:
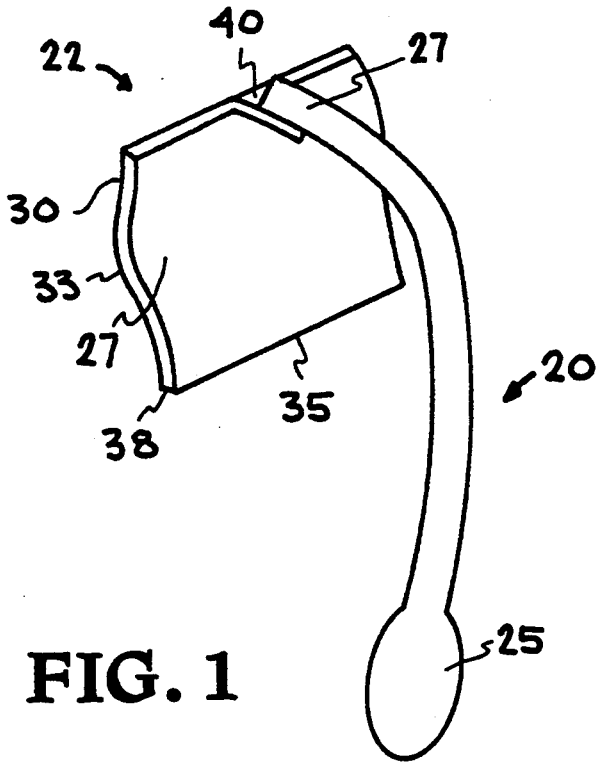
FIG. 1 is a perspective view of a first embodiment of the invention.

With reference to FIG. 1, a tail 20 is shown attached to a flap 22. The tail 20 in this embodiment is representative of a large cat such as a lion, and is covered with a soft cloth over most of its length, with a fur covered tip 25 at an opposite end from an attachment end 27. Depending upon coloration, tail 20 could alternatively represent another cat such as a cheetah, an endangered species such as a snow leopard, a giraffe, a cow or other animals.

The flap 22 is soft and flexible, and has a generally rectangular outer major surface 27 and inner major surface 30, the surfaces 27 and 30 having areas defined by a length 33 and a width 35 of the flap 22. The flap 22 has a thickness 38 that is much smaller than either the length 33 or width 35. A thin, flexible extension 40 protrudes near a center of a top of the flap 22, offering a detachable mechanism for attaching end 27 to the extension 40, such as a hook and loop system similar to that sold under the trademark "VELCRO", not shown. The end 27 is designed to disconnect from the flap 22 at a minimum force which may range between 1 lb and 6 lbs, or may, as discussed below, be permanently attached. The inner surface 30 may be made from a soft cloth or patterned or silk-screened material, while the outer surface 27 may have a fur coating that is made of the same material found on the tip 25. In general it is desirable that the outer surface 27 have a coefficient of friction higher than that of the inner surface 30, in order for the inner surface 30 to be comfortable to a child's backside while the outer surface 27 is frictionally engaged with an inside of the child's pants or skirt. The outer surface 27 and the tail 20 may be made of a fur common to plush animal toys.

Figure 2:
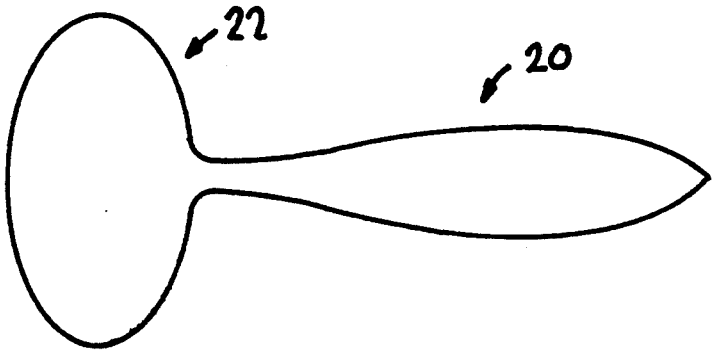
FIG. 2 is a top view of a second embodiment of the invention.

FIG. 2 shows an embodiment in which the tail 20 is permanently attached to the flap 22. The tail 20 shown in this figure is covered with synthetic hair or fur, and can represent a tail of a dog, cat, fox, wolf, skunk, horse, squirrel or other animal, depending upon the coloring and length of the hair or fur. The flap 22 has an oblong or elliptical shape that is designed to be frictionally engaged with clothing of a child to hold the weight of the tail 20, but to allow the tail 20 and flap 22 to be easily pulled free from the clothing.

Figure 3:
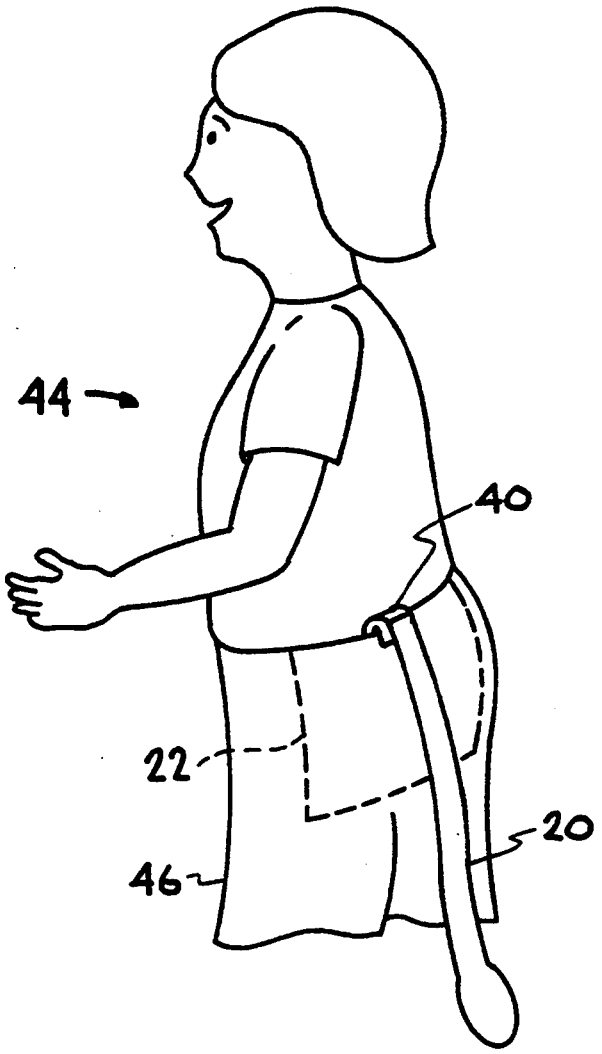
FIG. 3 is a perspective view of the first embodiment worn by a child.

Referring now to FIG. 3, the tail 20 and flap 22 of FIG. 1 is shown as it appears when worn by a child 44. The flap 22 is tucked into a back of a pair of pants 46 worn by the child 44. The extension 40 hangs outside of the pants 46, which allows the tail 20 to detach from the child 44 when the tail is pulled with a set level of force, as might happen should the tail 20 become caught while the child 44 is moving, or if another child grabs and pulls on the tail 20.

Figure 4:
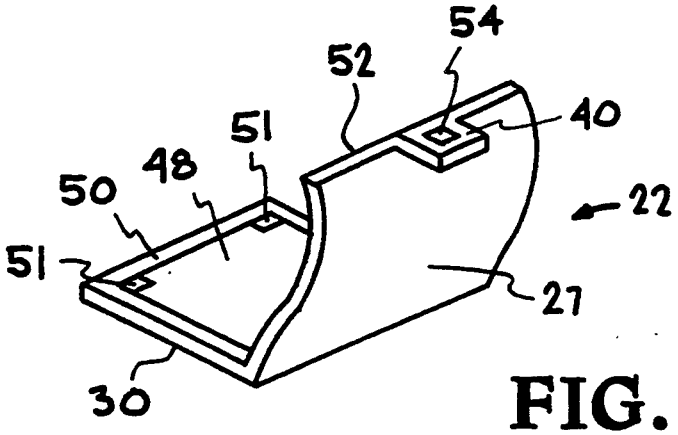
FIG. 4 is a perspective view of a folding flap embodiment of the invention.

FIG. 4 shows a flap 22 that can unfold to reveal a picture or story relating to the animal depicted by the tail, generally defined as indicia regarding the animal. The flap 22 has a first inside surface 48 disposed opposite to inner surface 30 and having a strip 50 of hook and loop material mounted near a perimeter of a that surface 48. Instead of strip 50, tags 51 of hook and loop material may be provided near corners of surface 48. Note that the strip 50 and tags 51 are shown together for illustrative purposes and would not normally be employed together. A second inside surface 52 disposed opposite to the outer surface 27 has a strip of hook and loop material or tags, not shown, that mates with the strip 50 or tags 51 to hold the flap 22 closed while it is tucked into the clothes of a child. A tab 54 of similar hook and loop material can be seen to be located on the extension 40 for attachment to the tail 20, not shown in this figure. Incorporating a story or picture relating to the animal associated with the tail 20 enhances the enjoyment and appreciation of both the tail 20 and the animal associated with the tail 20 by a child. Moreover, having a tail 20 associated with an animal attached to a book or story offers a non-conventional method of encouraging reading among young children.

Figure 5:
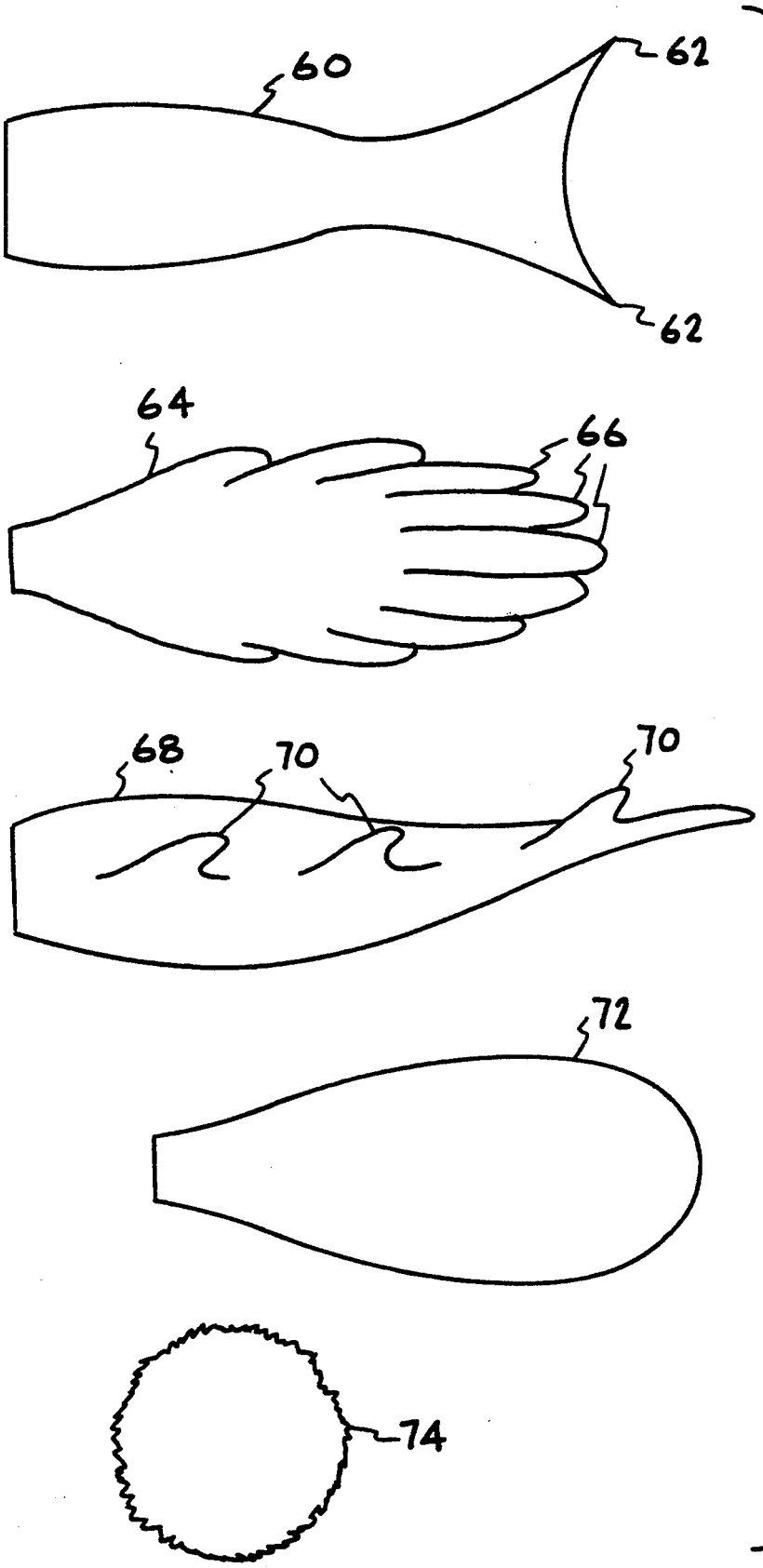
FIG. 5 is a top view of several tail embodiments of the invention.

FIG. 5 shows various types of tails 20 that are detached from the flap 22, but could alternatively be of the embodiment depicted in FIG. 2 for which the tail 20 and flap 22 are permanently connected. A smooth tail 60 having a forked tip 62 may be associated with a fish or marine mammal such as a whale or dolphin and may be made of soft cloth or synthetic material such as plastic. Varying the orientation of such a forked tail 60 and having one fork 62 longer than another can cause that tail 60 to represent a shark or other fish. A representation of a bird tail 64 can be seen to have a number of feathers 66 that may be made of strips of cloth. A reptile or dinosaur tail 68 has several soft protrusions 70 that may also be representative of a dragon. A beaver tail 72 is fiat and oblong, while a rabbit tail 74 may be spherical and fluffy.

It should be noted that the foregoing description and drawings were given for illustrative purposes only, it being understood that the invention is not limited to the embodiments disclosed, but is intended to embrace any and all alternatives, equivalents, modifications or rearrangement of elements falling within the scope of the invention as defined by the following claims.

I claim:

1. A costume toy for wearing by a child clothed with a garment extending downward from the waist, comprising:

a soft, flexible flap having a similar length and width encompassing a perimeter of opposed major surfaces and having a thickness between the surfaces much smaller than the length and the width, and a soft, flexible tail with an end attached to the flap near the perimeter, and the major surfaces each defining a surface area appreciably greater than a transverse cross-section of the tail at the end attached to the flap.

2. The toy of claim 1 wherein the end is attached to the flap with a hook and loop fastener having a predetermined maximum strength, such that the tail detaches from the flap when pulled with sufficient force.

3. The toy of claim 1 wherein a first of the surfaces has an attachment means for detachably holding the first surface folded together, the first surface housing indicia regarding a creature represented by the tail.

4. The toy of claim 1 wherein the tail is shaped like that of a mammal.

5. The toy of claim 1 wherein the tail is shaped like that of a reptile.

6. The toy of claim 1 wherein the tail is shaped like that of a fish.

7. The toy of claim 1 wherein the tail is shaped like that of a dragon.

8. The toy of claim 1 wherein the tail is shaped like that of a bird.

9. The toy of claim 1 wherein the tail is shaped like that of a dinosaur.

10. A toy for wearing by a child comprising:

a soft, flexible simulated animal tail, a soft, flexible flap having a perimeter attached to an end of the tail, the flap having a surface area appreciably greater than a transverse cross-section of the tail at the end attached to the flap, the flap for tucking into clothing worn by the child, such that the flap is frictionally held by the clothing with the tail hanging from the flap outside the clothing.

11. The toy of claim 10 wherein the flap and the end of the tail have a mated hook and loop structure, whereby the tail can be pulled from the flap with the flap tucked into the clothing.

12. The toy of claim 10 wherein the flap has first and second major surfaces separated by the perimeter, the first surface being substantially smoother than the second surface.

13. The toy of claim 10 wherein the flap has first and second major surfaces that are generally elliptically shaped.

14. The toy of claim 10 wherein the flap has first and second major surfaces that are generally rectangularly shaped.

15. A method for safely promoting imagination and empathy among children comprising:

providing a soft tail and flap toy to a child, the tail representing an animal, tucking the flap into the clothing of the child near a rear of the child, such that the tail appears attached to the rear of the child, and encouraging the child to imagine that the child is the animal represented by the tail.

16. The method of claim 15 wherein tucking the flap into the clothing of the child is performed by the child, thereby promoting independence and self confidence of the child.

17. The method of claim 15 further comprising acting as though the child is the animal represented by the tail, thereby encouraging self expression of the child.

18. The method of claim 15 further comprising providing indicia on the flap regarding the animal represented by the tail, thereby providing knowledge of the animal to the child.

* * * * *